United States Patent [19]

Goldhammer

[11] Patent Number: 4,477,702

[45] Date of Patent: Oct. 16, 1984

[54] CLOSURE INDICATOR FOR THE DOOR OF A BALING PRESS

[75] Inventor: Albert Goldhammer, Überlingen, Fed. Rep. of Germany

[73] Assignee: Firma Feinwerktechnik Schleicher & Co., Markdorf, Fed. Rep. of Germany

[21] Appl. No.: 362,467

[22] Filed: Mar. 26, 1982

[30] Foreign Application Priority Data

Mar. 31, 1981 [DE] Fed. Rep. of Germany ..... 3112719

[51] Int. Cl.[3] ..... H01H 3/16

[52] U.S. Cl. ..... 200/61.62; 200/155 A; 340/545

[58] Field of Search ..... 200/61.62, 61.72, 155 A, 200/153 T, 153 LB; 340/545, 549

[56] References Cited

U.S. PATENT DOCUMENTS

| | | | |
|---|---|---|---|
| 2,532,000 | 11/1950 | West | 200/153 LB |
| 3,435,643 | 4/1969 | Pollack et al. | 340/545 |
| 3,504,144 | 3/1970 | Horner | 200/61.62 |

*Primary Examiner*—Patrick R. Salce
*Assistant Examiner*—Morris Ginsburg
*Attorney, Agent, or Firm*—Lackenbach, Siegel, Marzullo, Presta & Aronson

[57] ABSTRACT

A closure indicator for the door of a baling press, comprising at least one switch finger disposed on the swingable part of the door, which switch finger is adapted to actuate one or more switching cams of electrical switches disposed in said baling press, and said switch finger actuates a disc cam having control surfaces which are situated under a spring-loaded electrical switching element.

6 Claims, 2 Drawing Figures

CLOSURE INDICATOR FOR THE DOOR OF A BALING PRESS

Figure 1:
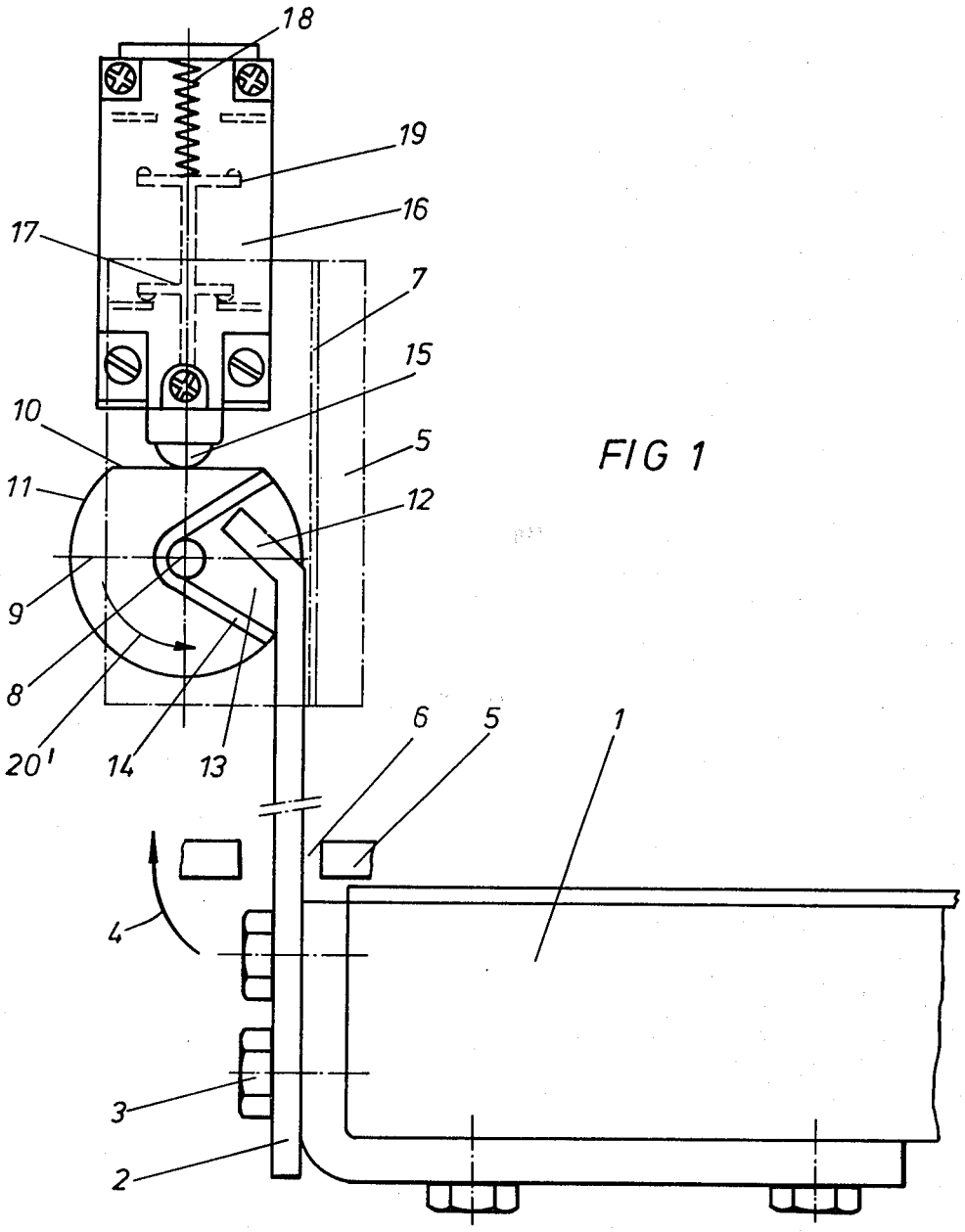

The subject matter of the invention is a closure indicator for the door of a baling press with one or more switch fingers disposed at the swingable end of the door, which switch finger or fingers actuates one or more followers of electrical switches hidden or disposed in a recess of the press case.

The initially mentioned closure indicator provides a safety device for the door of a baling press, which upon actuation closes an electrical contact, which releases the current supply to the drive aggregates of the baling press. It is the purpose of this step to allow a turning on of the electrical aggregates of the baling press only then, when the door is completely closed and bolted. Thereby, one is prevented from reaching through the closure door of the baling press during operation.

The present invention has as an object to produce an initially mentioned contact safe for operation and at favorable costs.

The object of the invention is achieved by the switch finger actuating a disk cam, at the control surfaces of which the switch cam follower is disposed with spring loading.

In accordance with the invention, there is thus disclosed to switch indirectly by a disk cam, such that the switch finger does not immediately actuate the switch cam of the electrical switch. Thereby the requirement is met that the contact at closed door is closed under the spring force of a spring disposed in the switch casing, while at opened door, the switch finger disposed at the swingable end of the door actuates the disk cam and the control faces disposed at the disk cam break the operating contact by way of the actuating power on the disk cam and, in fact, against the force of the spring 18 (see FIG. 1) disposed in the casing. Thereby, necessarily even a welded contact is ripped open, such that in the case of an opened door at any rate the operating contact is opened and thus the electrical drive elements of the baling press are stopped.

In addition, upon the opening of the operating contact a second contact can be closed, which controls suitably exhibit corresponding warning displays, which indicate at the operating table of the baling press, that the door is opened, and that the drive is stopped and that material can now be filled in.

A particularly simple and economically produced embodiment of the disk cam results by disposing the disk cam rotatable at the press case and by providing a sector shaped recess at the disk cam into which engages the offset part of the switch finger. Based on the position of a sector shaped recess thus there results an eccentric actuation of the disk cam in the sense of a rotation by the switch finger. Thus the switch finger acts like a driving pawl, which engages in the sector shaped recess and which attacks at a wall remote from the door of the sector shaped recess in the closed position of the door, while during the transition from the closed door to the open door the offset part of the switch finger attacks at the part of the sector shaped recess close to the door.

A further embodiment provides that the rotation drive of the disk cam is furnished by having a toothed rack disposed at the switch finger, which toothed rack meshes with the disk cam which is formed as a pinion.

In view of the first described embodiment (switch finger as driving pawl in a sector shaped recess), it is in this context which is preferred, if the control surface coordinated to the closed position of the door is formed as a straight line and if the control surface coordinated to the opened position of the door is formed as radius of the disk cam. A straight line forming control surface gives the advantage that over a large region of rotation of the disk cam there is achieved a stable switching state and thus a safe closed state of the operating contact.

At the transition from the closed state to the opened state therefor the switch cam follower of the switch sitting on the straight line forming control surface has to be moved initially under furnishing of a torque via the edge, which results at the transition from the straight control surface to the control surface forming a radius. Thus, there results some kind of over dead point actuation with a defined transition from the closed state to the open state.

Thus there is achieved a certain snap-in effect of the disk cam, which is further improved by providing to the control surface formed as a radius of the disk cam a detent or recess (not shown) for the switch cam of the switch.

All data and features presented in the materials and in particular the special embodiment illustrated in the drawing are claimed as essential to the invention as far as they are novel versus the state of the art whether taken alone or in combination.

In the following the invention is described in more detail by way of the drawing showing only one way of embodiment. Thereby additional invention essential features and advantages are recognized from the drawing and its description.

Figure 2:
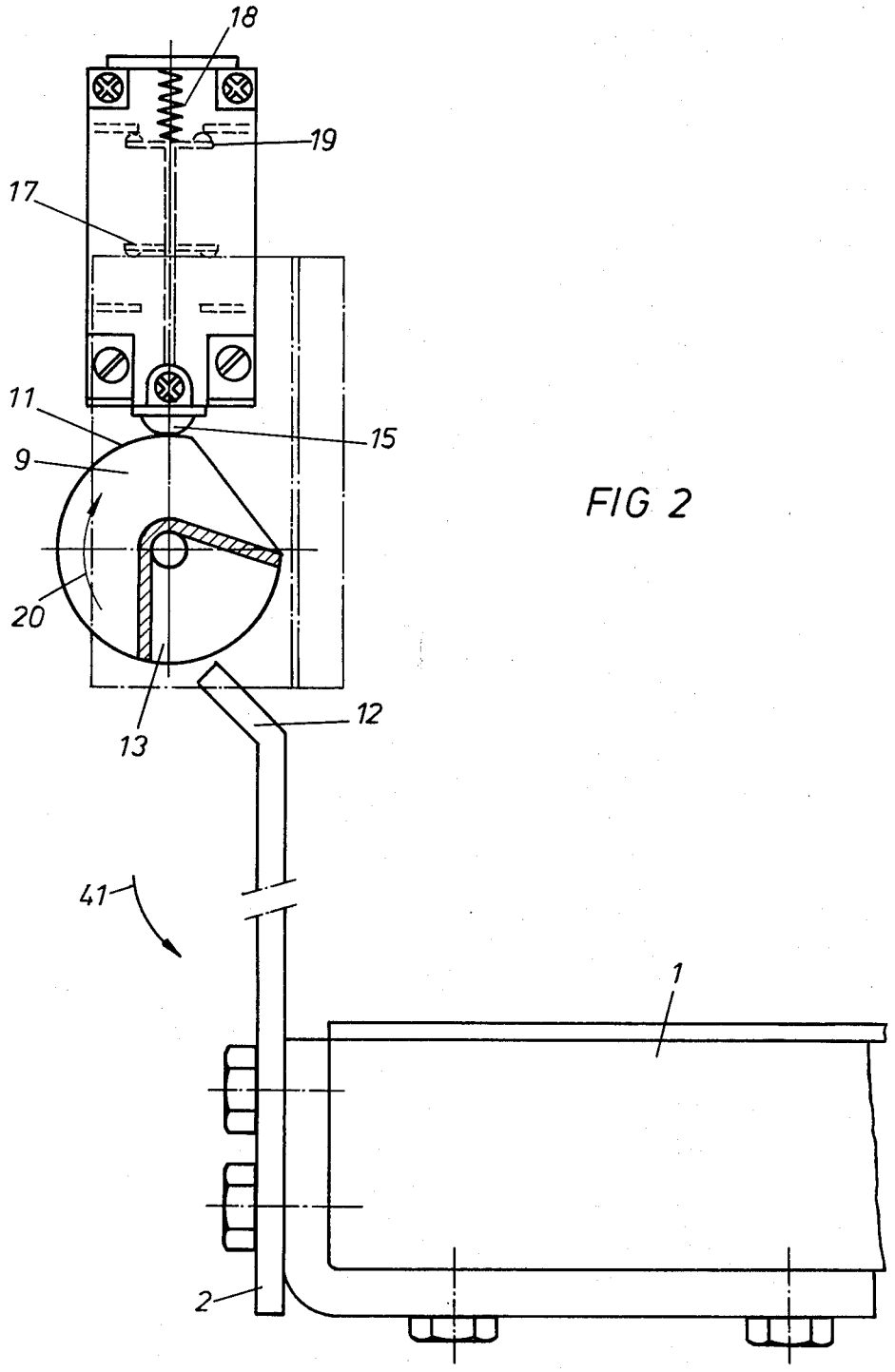

There is shown in:

FIG. 1 a closure indicator according to the invention at closed door;

FIG. 2 a closure indicator at opened door.

Only the free swingable end or part of the door of a baling press is shown in the drawings, at which the switch finger 2 is adjustably attached via bolt connections 3. The switch finger 2 is shown shortened, in practical applications it has a length of from 20 to 30 centimeters and it passes with its offset front part 12 deep into the press case 5 via a recess or opening 6. The complete closure indicator is thus deeply hidden in the press case 5 and thus cannot any longer be manipulated by hand.

A sheet metal bracket 7 is disposed in the press case 5 and the rotation axle 8 of the disk cam 9 is rotatably attached to the sheet metal bracket. The disk cam 9 is provided with a V-shaped or respectively sector shaped recess 13, which extends from the rotation axis expanding toward the outside circumference. The recess 13 comprises a sector shaped piece 14 of sheet metal attached to the flat side of the disk cam 9 according to the embodiment shown.

According to another embodiment not shown in detail instead of the piece of sheet metal 14 such a recess 13 can also be milled out of the disk cam 9.

At the closed position of the door, the offset part 12 of the switch finger 2 engages the side of the wall of the recess 13 disposed remote from the door and thus keeps the disk cam 9 in the position shown in FIG. 1.

The switch cam follower 15 of an electrical switch 16 thereby is disposed at the straight line formed control surface 10 of the disk cam 9, whereby at the same time the operating contact 17 is closed, which releases the current for the electrical drive aggregate. At the same time a control contact 19 is in open position. The closing of the operating contact 17 is performed under the force of a spring 18 disposed in the switch 16. At the transition from the opened door to the closed door here the cam disk is turned in the direction of the arrow 20' by attack of the offset part 12 of the switch finger 2 at the wall of the recess 13 disposed remote from the door.

The rotation is performed when the switch finger 2 is moved in the closure direction 4 against the disk cam 9.

Upon opening of the door according to FIG. 2 in opening direction, then the disk cam 9 is necessarily turned in the direction of arrow 20 by sliding the offset part 12 of the switch finger 2 along the face of the recess 13 disposed adjacent to the door and the disk cam is turned in the direction of arrow 20. Thereby the spring loaded switch cam follower 15 of the switch 16 passes over the edge acting as an over dead point between the straight control surface 10 and the control surface 11 formed as radius of the disk cam 9, whereby at the same time the switch cam follower 15 is pressed into the casing of the switch and the operating contact 17 is ripped open by the rotation of the cam disk 9. After the rotation of the disk cam 9 has been performed directly by the opening power of the door 1, the disk cam 9 transfers such a large force to the switch cam follower 15 of the switch 16 that always a ripping open of the operating contact 17 is assured even in case of a welded contact. At the same time, the control contact 19 is closed against the force of the spring 18, which now induces the lighting of certain indications at the operating panel of the baling press. Such an indication is for example that the drive is stopped and that material can be filled in.

The disk cam 9 is spring loaded with a torsion spring in the direction of arrow 20 so that the switch cam follower 15 does not slide out of the detent position, and in the opened position of the door the switch cam 15 slides back onto the straight control surface 10. In addition, a detent recess can be provided in the region of the control surface 11 in order to induce the switch cam follower 15 to snap-in.

I claim:

1. A closure indicator in combination with a baling door of a baling press comprising: at least one switch finger disposed on the swingable part of said door, which switch finger is adapted to actuate at least one switching cam of electrical switch means disposed in said baling press, said switching cam having control surfaces in the form of a straight surface and a sector-shaped recess, the former of which is associated with the closed position of said door; a spring-loaded electrical switching element situated in line with said control surfaces of said cam; and said switch finger engaging or catching said sector shaped recess of said cam upon said door swinging into a closed position and actuating said cam.

2. The combination according to claim 1, wherein said cam is rotatably supported and adapted to be engaged with an offset part of the switch finger.

3. The combination according to claim 1 or 2, wherein said control surface associated with the open position of the door is provided as a radius of the cam.

4. The combination according to claim 2, wherein said sector-shaped recess of the cam is a V-shape.

5. The combination according to claim 1, wherein said cam is held in an angular position corresponding to the closed position by biasing means.

6. The combination according to claim 3 wherein said control surface provided as a radius of the cam is provided with a mating area for cooperation with the spring-loaded electrical switching element of said electrical switch means.

* * * * *